US006115009A

United States Patent [19]

Ikegami

[11] Patent Number: 6,115,009

[45] Date of Patent: Sep. 5, 2000

[54] VIDEO SIGNAL COUNTER SYSTEM FOR AUTOMATIC POSITIONING AND CENTERING CIRCUIT

[75] Inventor: Hiroyuki Ikegami, San Diego, Calif.

[73] Assignees: Sony Corporation of Japan, Tokyo, Japan; Sony Electronics, Inc., Park Ridge, N.J.

[21] Appl. No.: 09/097,992

[22] Filed: Jun. 16, 1998

[51] Int. Cl.[7] ..... G09G 1/06

[52] U.S. Cl. ..... 345/10; 345/13; 345/22; 345/150; 345/213; 315/370

[58] Field of Search ..... 345/10, 11, 12, 345/13, 14, 15, 22, 20, 150, 153, 154, 155, 204, 205, 213, 211, 212; 315/370

[56] References Cited

U.S. PATENT DOCUMENTS

| | | | |
|---|---|---|---|
| 4,649,324 | 3/1987 | Guerra et al. | 315/370 |
| 5,623,272 | 4/1997 | Mori et al. | 345/13 |
| 5,670,972 | 9/1997 | Kim | 345/13 |
| 5,828,351 | 10/1998 | Wu | 345/10 |
| 5,886,677 | 3/1999 | Woo | 345/13 |
| 5,889,500 | 3/1999 | Chuang et al. | 345/10 |
| 5,933,126 | 8/1999 | Mori | 345/13 |

*Primary Examiner*—Xiao Wu
*Attorney, Agent, or Firm*—Wagner, Murabito & Hao LLP

[57] ABSTRACT

A display device using a video signal counter system in its automatic positioning and centering circuit. The display device receives a video signal (e.g., from a host computer) including red, green, blue (RGB) color signals and synchronization signals. The present invention advantageously utilizes a video signal counter circuit which is located proximate to, and on the same integrated circuit PC board as, the video receiver circuit of the display device to increase the accuracy of automatic centering and sizing computations. The video signal counter circuit compares horizontal and vertical synchronization signals to the start of the picture edge as determined by the RGB signals. The video signal counter circuit communicates over a transmission line (e.g., serial line) to a processor unit located on another integrated circuit PC board. The processor unit uses the signals generated by the video signal counter circuit to perform automatic sizing and centering computations and generates, as output, vertical and horizontal sizing and vertical and horizontal centering signals. These signals are supplied to a yoke controller/driver circuit which drives the deflection circuitry of a cathode ray tube (CRT) type display unit. By positioning the video signal counter circuit on the same PC board as the receiver unit, signal jitter and EMI noise problems are reduced. The transmission line between the video signal counter circuit and the microprocessor can be shielded thereby further reducing EMI noise. Noise is reduced again by positioning the microprocessor on the same PC board as the yoke driver circuit.

20 Claims, 7 Drawing Sheets

VIDEO SIGNAL COUNTER SYSTEM FOR AUTOMATIC POSITIONING AND CENTERING CIRCUIT

BACKGROUND OF THE INVENTION

1. Field of the Invention

The present invention relates to the field of electronic circuitry for display devices. More specifically, the present invention relates to the field of display device technology that automatically detects and responds to video signals of differing video formats.

2. Related Art

Cathode ray tube (CRT) display devices have been used in conjunction with computer systems for many years. CRT display devices display information to computer users in the form of graphic images. Basic to all CRT displays is a cathode ray tube including a screen having phosphor disposed thereon. An electron gun is used that emits an electronic beam which is directed toward the phosphor thereby causing the emission of light. The electron beam is controlled by deflection units that use magnetic fields to sweep the electron beam across the screen in horizontal lines from top to bottom traversing the vertical dimension of the screen (e.g., to display a field or frame of information). Frames are typically presented on the screen at rates of between 40–60 Hz. Vertical and horizontal timing pulses synchronize the electron beam. The emission of electrons from the electron gun is controlled by color signals (e.g., read, green, blue).

Computer systems generate video signals (e.g., RGB and synchronization signals) that are used to control a CRT display device. There are currently many different video signal formats that computer systems use and each video signal format offers different numbers of pixels along the horizontal and vertical dimensions of the screen. For instance, one video signal format divides the screen into 640 pixels along the horizontal and 480 pixels along the vertical (e.g., "640×480"). Another popular video signal format divides the screen into 1024 pixels along the horizontal and 768 pixels along the vertical (e.g., "1024×768"). In the past, the electronics of a given CRT display device was manufactured to be compatible with only one video signal format. Therefore, the computer system's video format and the CRT display device's video format needed to match exactly for proper operation and image quality.

However, with the emergence of many video formats in the commercial market for computer systems, and with today's computer systems being able to support multiple video signal formats, display manufactures have responded by developing a CRT display device that is automatically compatible with several different video signal formats. Recently, CRT display devices have been introduced that automatically detect and respond to several different video signal formats without user intervention. These CRT display devices contain circuitry that performs "automatic sizing and centering" functions to properly locate the frames on the display screen regardless of the video signal format (within some range of accepted and standardized video signal formats)

FIG. 1A illustrates circuitry used within one such prior art CRT display device 10*a* that performs automatic sizing and centering functions thereby making it compatible with multiple video signal formats. The CRT display device 10*a* includes at least two PC boards, a first board 12*a* and a second board 14*a*. The first board 12*a* receives video color signals 16 and synchronization signals 18 and 20 (e.g., originated from a video card of a host computer system). A video receiver circuit 30 is used to amplify the video color signals 16 and supply them to an OR circuit 32 which supplies an OR signal to a microprocessor unit 34. The microprocessor unit 34 compares this OR signal with the synchronization signals 18 and 20 and generates sizing signals 22 and centering signals 24 which are sent to the second board 14. The second board 14*a* includes a yoke control device 36 which uses the sizing 22 and centering signals 24 to control the deflection of the electron beam within a cathode ray tube 40. The microprocessor unit 34 performs automatic sizing and centering functions so that the CRT device 10*a* can automatically detect and respond to different video signal formats.

One problem with the design 10*a* of FIG. 1A is that the first board 12*a* needs to be closely located to the second board 14*a* due to noise and signal jitter issues with respect to the analog sizing 22 and centering signals 24. Also EMI radiation from the analog video signal (signals 16, 18 and 20) is a problem as is signal delay from the first board 12*a* to the second board 14*a*. However, design flexibility of the overall circuit 10*a* is reduced if the first board 12*a* is required to be tightly positioned with respect to the second board 14*a*. One method for reducing the noise problem is to use costly EMI protection covering. However, this solution is not commercially advantageous due to the additional cost required for shielding and also because this solution does not solve the underlying signal delay problems. Therefore, it would be advantageous to reduce or eliminate the noise and signal delay problems referenced above to obviate any requirement that the first board 12*a* be closely positioned with respect to the second board 14*a*.

Another problem associated with the design 10*a* of FIG. 1A is that once the position of the microprocessor 34 is fixed, it becomes very difficult to optimize the layout of the remainder of the components because a great deal of attention needs to be paid to noise, signal delay and EMI susceptibility. For instance, generally once the position of the large microprocessor 34 is fixed, it is not always guaranteed to be near the video receiver 30, thereby causing noise and jitter problems associated with the transmission lines between the input video signal and the microprocessor 34. It would be advantageous to provide an automatic sizing and centering design that has reduced susceptibility to noise, signal delay and EMI problems. Another problem with the design 10*a* of FIG. 1A is that the microprocessor 34 typically operates at a lower frequency (e.g., 32 MHz) with respect to the input video signal. Lower frequency translates into lower accuracy of the automatic sizing and centering functions.

FIG. 1B illustrates circuitry used within another prior art CRT display device 10*b* that performs automatic sizing and centering functions like circuit 10*a* thereby making it compatible with multiple video signal formats. The CRT display device 10*b* also includes at least two PC boards, a first board 12*b* and a second board 14*b*. However, in circuit 10*b*, the microprocessor unit 34 is included on first board 12*b*. This prior art circuit 10*b* also has EMI issues and signal delay issues, as discussed above, with respect to line 46. Line 46 connects between the first board 12*b* and the second board 14*b*. In view of the above problems, it would be advantageous to provide automatic sizing and centering functionality with increased accuracy.

SUMMARY OF THE INVENTION

Accordingly, the present invention provides an electronic design for automatic sizing and centering within a CRT display device having reduced susceptibility to noise, signal delay and EMI problems and increased accuracy of the automatic sizing and centering functions. Further, the present invention provides an electronic design for automatic sizing and centering within a CRT display device having improved design flexibility wherein the video board does not necessarily need to be located near the main board. These and other advantages of the present invention not specifically mentioned above will become clear within discussions of the present invention presented herein.

A display device is described herein using a video signal counter system in its automatic positioning and centering circuit. The display device receives a video signal (e.g., from a host computer) including red, green, blue (RGB) color signals and synchronization signals. The present invention advantageously utilizes a video signal counter circuit which is located proximate to, and on the same integrated circuit PC board as, the video receiver unit of the display device to increase the accuracy of automatic centering and sizing computations. The video signal counter circuit compares horizontal and vertical synchronization signals to the start of the picture edge as determined by the RGB signals. The video signal counter circuit communicates over a transmission line (e.g., serial line) to a processor unit located on another integrated circuit PC board. The processor unit uses the signals generated by the video signal counter circuit to perform automatic sizing and centering computations and generates, as output, vertical and horizontal sizing and vertical and horizontal centering signals. These signals are supplied to a yoke controller/driver circuit which drives the deflection circuitry of a cathode ray tube (CRT) type display unit. By positioning the video signal counter circuit on the same PC board as the receiver unit, signal jitter and EMI noise problems are reduced. The transmission line between the video signal counter circuit and the microprocessor can be shielded thereby further reducing EMI noise. Noise is reduced again by positioning the microprocessor on the same PC board as the yoke driver circuit.

More specifically, embodiments of the present invention include a control circuit for a display device, the control circuit comprising: a) a first board comprising: a video receiver circuit for receiving video color signals of an input video signal; an OR circuit coupled to the video receiver circuit for generating an OR signal that is an OR function of the video color signals; and a video counter circuit coupled to the OR circuit and for comparing the OR signal with synchronization signals of the video input signal and for generating, over a serial transmission line, a digital count signal indicative thereof; and b) a second board coupled to the first board and comprising: a microprocessor coupled to the serial transmission line for performing automatic sizing and centering computations to generate horizontal and vertical sizing signals and for generating horizontal and vertical centering signals; and a yoke controller circuit coupled to receive the horizontal and vertical sizing signals and the horizontal and vertical centering signals and for controlling electronic beam deflection circuits within the display device.

Embodiments include the above and further comprising an On-Screen Display (OSD) circuit and wherein the video counter circuit is integrated within the OSD circuit of the first board. Embodiments include the above and wherein the video color signals include a red color signal, a green color signal and a the blue color signal and wherein the video synchronization signals include a horizontal synchronization signal and a vertical synchronization signal.

DETAILED DESCRIPTION OF THE INVENTION

In the following detailed description of the present invention, an automatic sizing and centering circuit for a monitor device, numerous specific details are set forth in order to provide a thorough understanding of the present invention. However, it will be recognized by one skilled in the art that the present invention may be practiced without these specific details or with equivalents thereof. In other instances, well known methods, procedures, components, and circuits have not been described in detail as not to unnecessarily obscure aspects of the present invention.

Figure 1A:
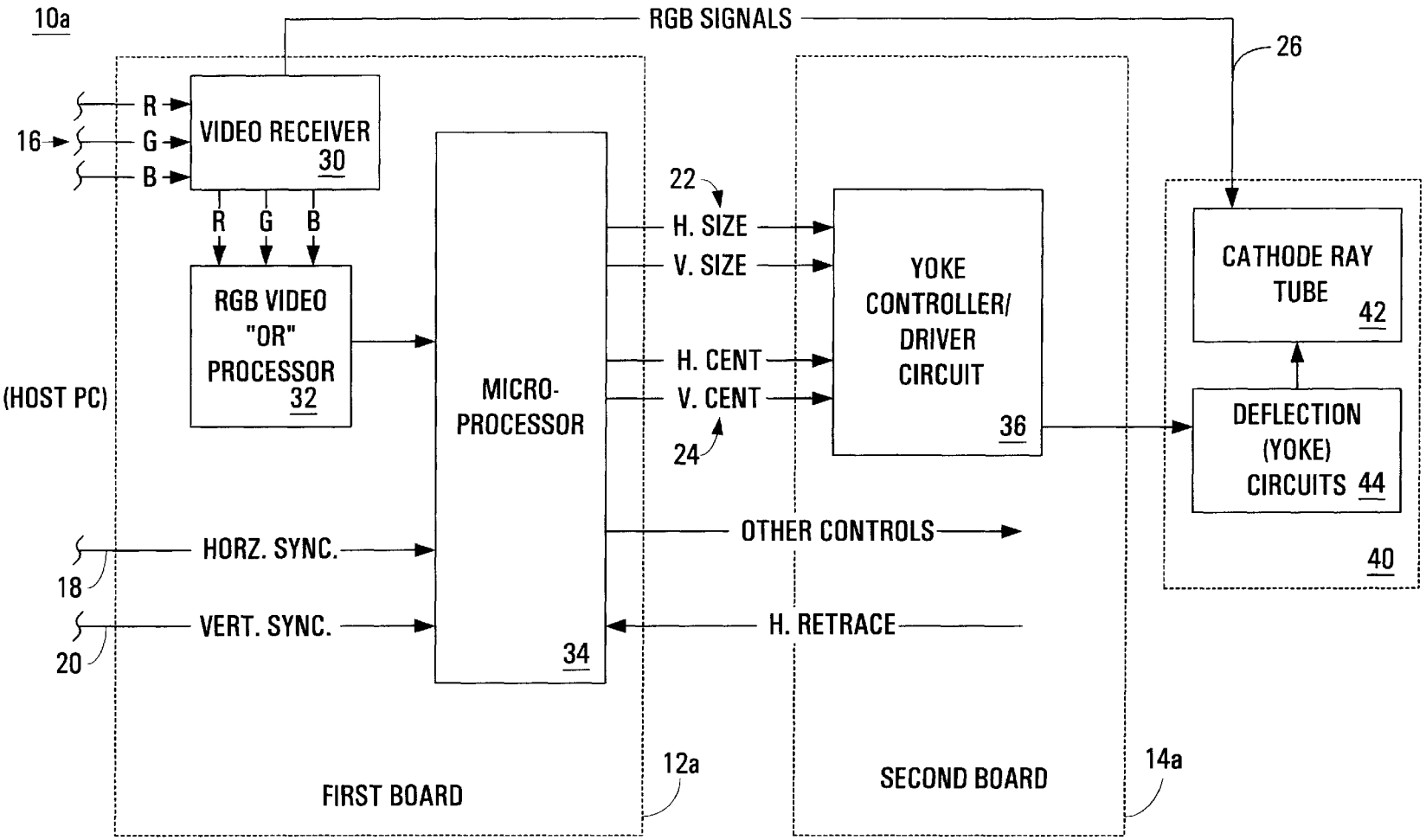
FIGURE 1A (PRIOR ART)
FIG. 1A illustrates one prior art automatic sizing and centering circuit design within a monitor device.
Figure 1B:
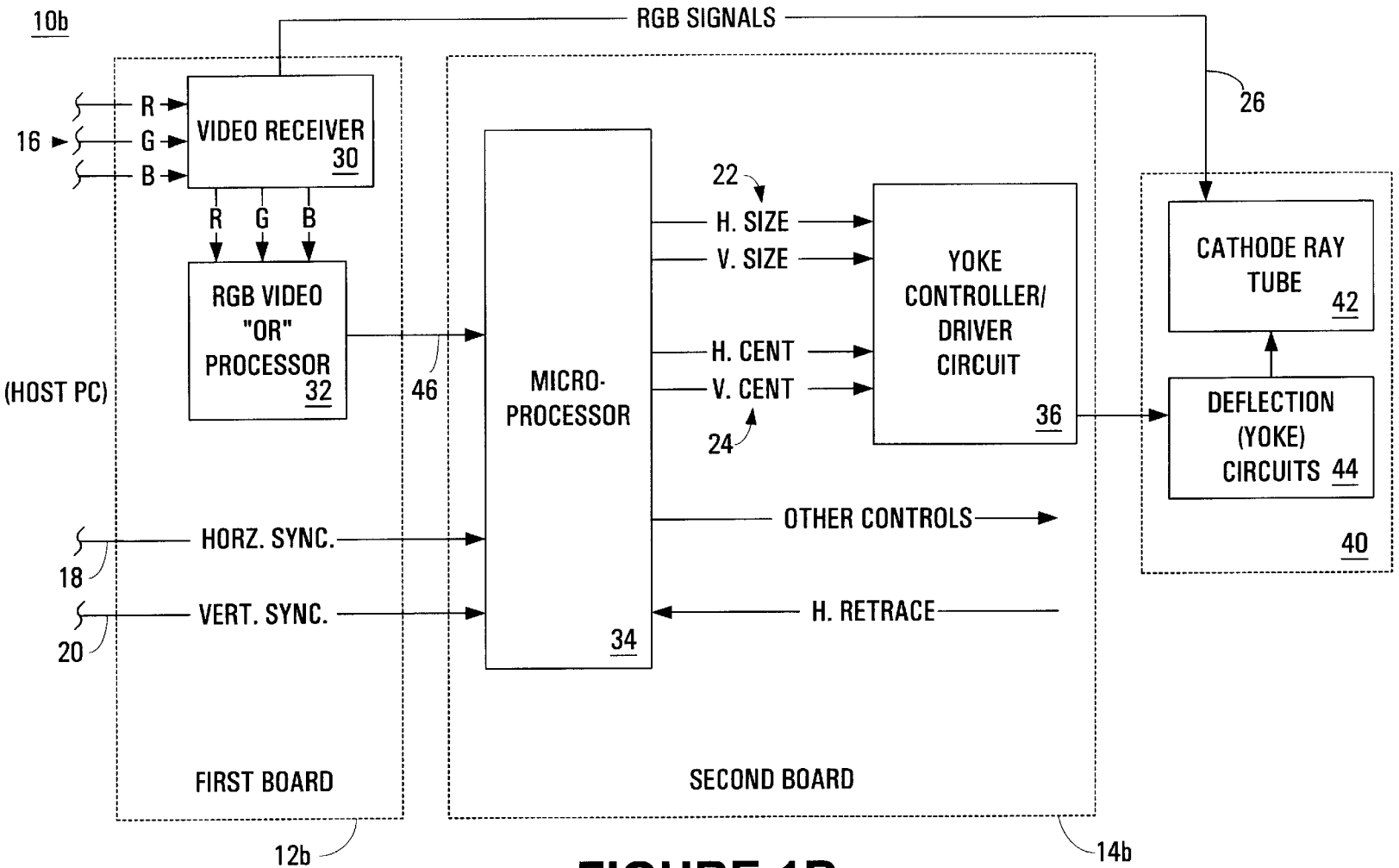
FIGURE 1B (PRIOR ART)
FIG. 1B illustrates a second prior art automatic sizing and centering circuit design within a monitor device.
Figure 2:
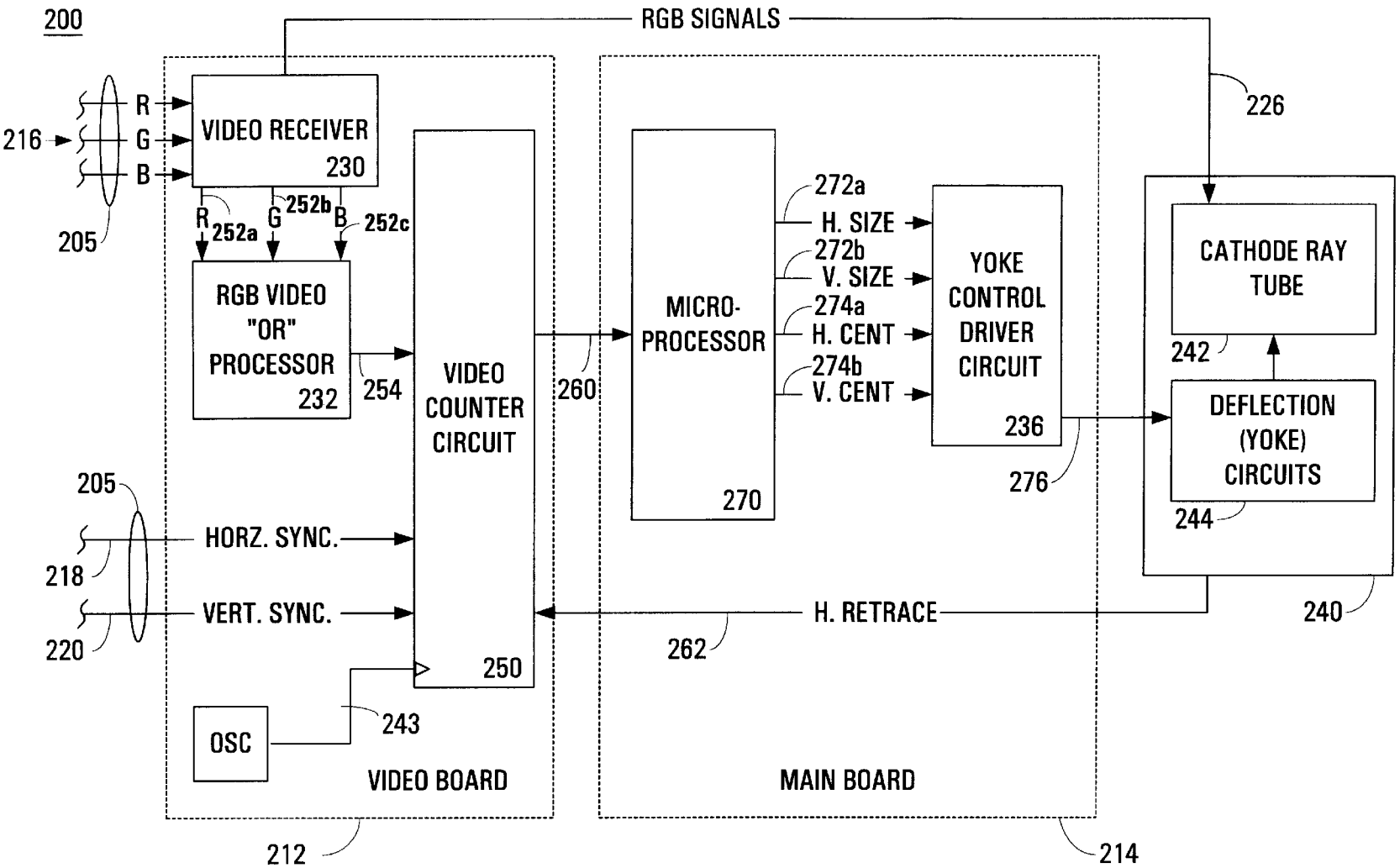
FIG. 2 illustrates an automatic sizing and centering circuit of one embodiment of the present invention including a video signal counter circuit located one the same PC board as the video receiver to reduce EMI noise and jitter problems.

FIG. 2 illustrates a block diagram of the automatic sizing and centering circuit 200 of one embodiment of the present invention for use within a cathode ray tube (CRT) display device. Circuit embodiment 200 includes a video board 212 coupled to a main board 214 via a serial communication line 260 and a horizontal retrace line 262. The horizontal retrace (or "flyback") line 262 is generated from CRT display unit 240. An input video signal, made up of red, green and blue video color signals of bus 216 and horizontal and vertical video synchronization signals of lines 218 and 220, is coupled to the video board 212. Circuit embodiment 200 also includes a cathode ray tube 242 and also magnetic deflection yoke circuits 244 for controlling the electron beam of the cathode ray tube 242. Cathode ray tube 242 and deflection circuits 244 are generally disposed together within CRT display unit 240. Cathode ray tube 242 and deflection circuits 244 are well known. Unit 240 is coupled to the main board 214 via analog bus 276 which carries deflection control, shaping and focus signals that are based on automatic sizing and centering operations of microprocessor 270. CRT display unit 240 is also coupled to the video board 212 to receive the video color signals over analog bus 226.

In accordance with the present invention, a video counter circuit 250 is located on the video board 212. Preferably, the video counter circuit 250 is located proximate to the video signal input port 205 and also located proximate to the video receiver 230 and the video OR processor 232. The video counter circuit 250 is so located to reduce signal noise and jitter problems associated with the input video signal. Because the pin count and physical size of the video counter circuit 250 is not as large as a microprocessor, the video counter circuit 250 is more readily positionable to be proximate to the video input receiver circuit 230 and the video OR processor 232. This advantageous location reduces signal noise, delay and jitter problems associated with these signal lines.

Figure 4:
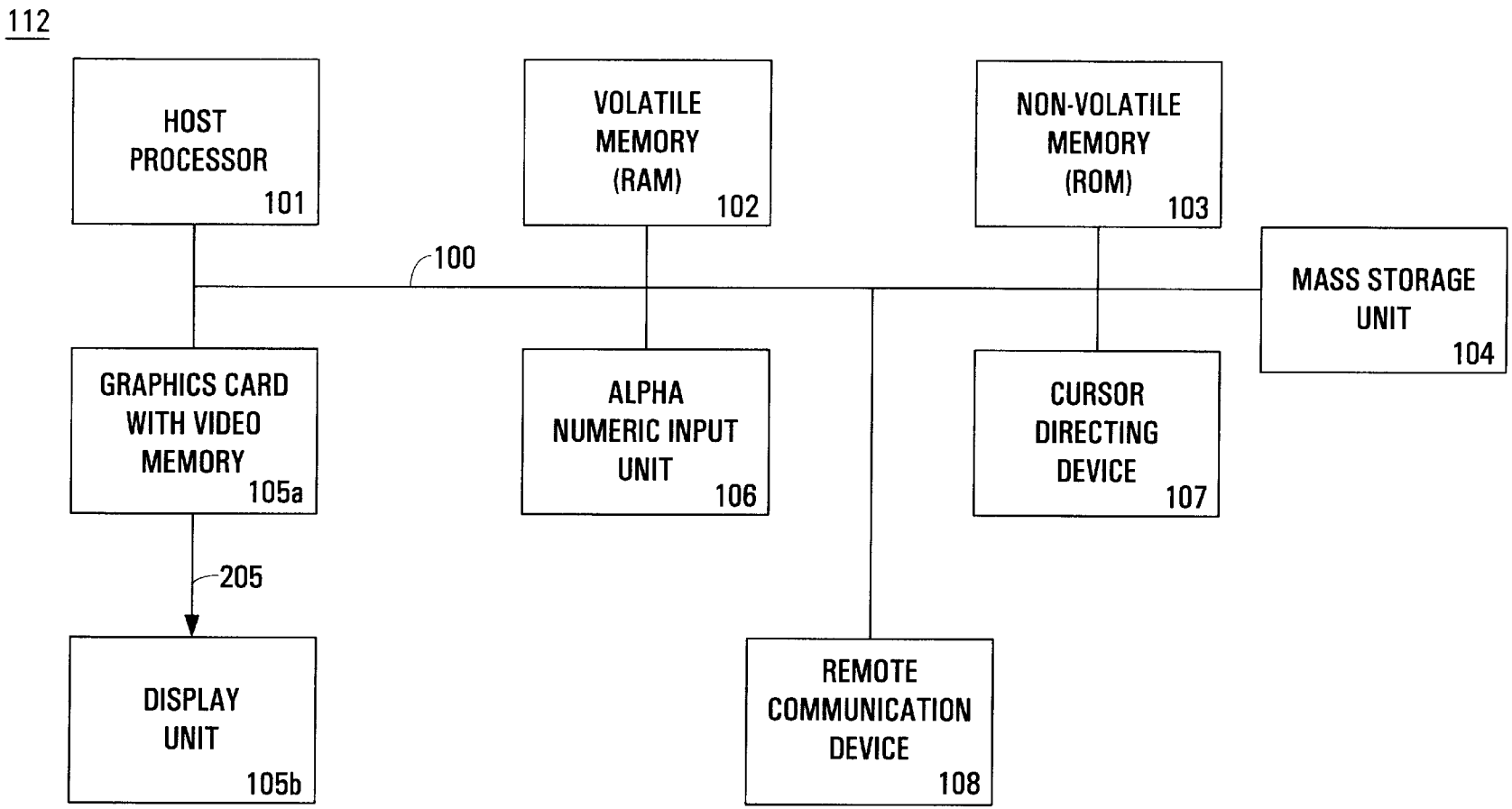
FIG. 4 illustrates a host computer system utilizing the monitor device of the present invention.

The input video signal (typically originating from a video card 105*a* of a host computer system 112, see FIG. 4) is coupled to port 205 and includes analog video color signals (of bus 216) and also video synchronization signals (over lines 218 and 220). Within the video board 212, the analog color video signals (e.g., red, green, blue) of bus 216 are coupled to a video receiver circuit 230 that amplifies these signals and supplies them over lines 252*a* (red), 252*b* (green) and 252*c* (blue) to a video OR processor 232. The video OR processor 232 performs an OR function on the video color signals and generates an OR signal which is digital pulse over line 254 whenever color data is present on any line of lines 252*a*–252*c*. Line 254 is coupled to the video counter circuit 250. As such, assertion of the digital output 254 of the OR processor 232 indicates, e.g., detects, the presence of color data within the input video signal. It is appreciated that any of a number of well known circuits can be used as the OR processor 232 within the present invention.

The video counter circuit of the video board 212 of FIG. 2 is clocked by a high frequency clock signal over line 243. In one embodiment, the clock signal is 100 MHz or greater. The video counter circuit 250 receives the OR signal over line 254 and also receives the horizontal synchronization signal over line 218 and the vertical synchronization signal over line 220 and a horizontal retrace signal over line 262. The video counter circuit 250 measures signal timing of the input video signals. In effect, the video counter circuit 250, in accordance with the present invention, compares the difference in time between the OR signal of line 254 and the above synchronization signals (e.g., the horizontal synchronization, the vertical synchronization and the retrace pulse) thereby determining the difference between the synchronization pulse and the start of the picture. The comparison of the RGB signals to the synchronization signals allows for a determination of the difference between the edge of the display screen and start of the actual picture edge.

In so doing, the video counter circuit 250 records any deviation of the video synchronization signals from the actual picture edge obtained from the OR signal. These digital count values are then down-loaded over a digital transmission line 260 to the main board 214. It is appreciated that in one embodiment, transmission line 260 is a digital serial transmission line (e.g., a IIC serial line), however, a parallel line could also be used. In one embodiment of the present invention, the digital transmission line 260 is shielded with material to protect the down-loaded count data from EMI radiation and other signal noise, jitter, etc.

In one implementation, the video counter circuit 250 is implemented using a dedicated chip. In another implementation, the video counter circuit 250 is integrated together with the OR processor 232 as a single integrated circuit device. In another embodiment, the video counter circuit 250 and the OR processor 232 are integrated within the video amplifier chip. This chip could be a monolithic integrated circuit.

FIG. 2 also illustrates the components of the main board 214. The main board 214 contains a microprocessor unit 270 and a yoke control/driver circuit ("yoke controller circuit") 236. The microprocessor unit 270 is coupled to receive the digital transmission line 260. Based on the digital count values the microprocessor receives over line 260, it performs well known automatic sizing and centering functions. The purpose of the automatic sizing and centering functions is to automatically place the picture in the center of the display device (with a comfortable size) regardless of the video format adopted by the input video signal. To this end, the microprocessor unit 270 generates several analog signals that are used to control the yoke controller circuit 236. For instance, a horizontal size signal is generated over line 272*a*. A vertical size signal is generated over line 272*b*. A horizontal centering signal is generated over line 274*a* and a vertical centering signal is generated over line 274*b*.

The sizing and centering signals discussed above are used to automatically place the picture in the center of the screen of the cathode ray tube 242 with a comfortable size for the viewer. In so doing, circuit embodiment 200 automatically responds to changes in the video resolution of the input video signal to properly center, size and shape the picture. The horizontal and vertical sizing signals of lines 272*a* –272*b* and the horizontal and vertical centering signals of lines 274*a* –274*b* are supplied to the yoke controller circuit 236 which controls the horizontal and vertical magnetic deflection circuits 244 of the cathode ray tube unit 240. Therefore, the yoke controller circuit 236 controls the deflection of the electron beam while the color signals over bus 226 controls the picture data (e.g., the content of the electron beam). It is appreciated that the horizontal retrace signal of line 262 is fed from the cathode ray tube unit 240 back to the video counter circuit 250 of the video board 212.

By advantageously placing the video counter circuit 250 proximate to the video receiver circuit 230 and the input video signal, the present invention reduces the effects of EMI radiation, signal jitter and noise from the horizontal synchronization signals of lines 218 and 220 and from the OR signal 254. By reducing these interfering elements, the video counter circuit 250 is able to more accurately provide the digital count over line 260. This leads to more accurate automatic sizing and centering operates that are performed by the microprocessor 270. Secondly, by providing the video counter circuit 250 with a faster clock signal over line 243, as compared to a microprocessor clock, the count value obtained by the video counter circuit 250 is more accurate.

Third, accuracy is increased by transmitting a digital version of the count signal to the main board as opposed to transmitting analog sizing and centering signals. The digital count value can be sent without interference by shielding transmission line 260. Further, by using buffers and/or driver circuits on line 260, the serial data transmission can be protected against signal noise and/or jitter. Fourth, accuracy is increased by the present invention by reducing the distance between the microprocessor 270 and the yoke controller circuit 236, because they are on the same board 214, thereby reducing the size of lines 272*a*, 272*b*, 274*a* and 274*b*. Lastly, by providing a separate video counter circuit 250, the selection of the position of the microprocessor 270 within the overall embodiment 200 can be made more flexible since it is the distance between the video counter circuit 250 and the input video signal that is minimized.

Figure 3A:
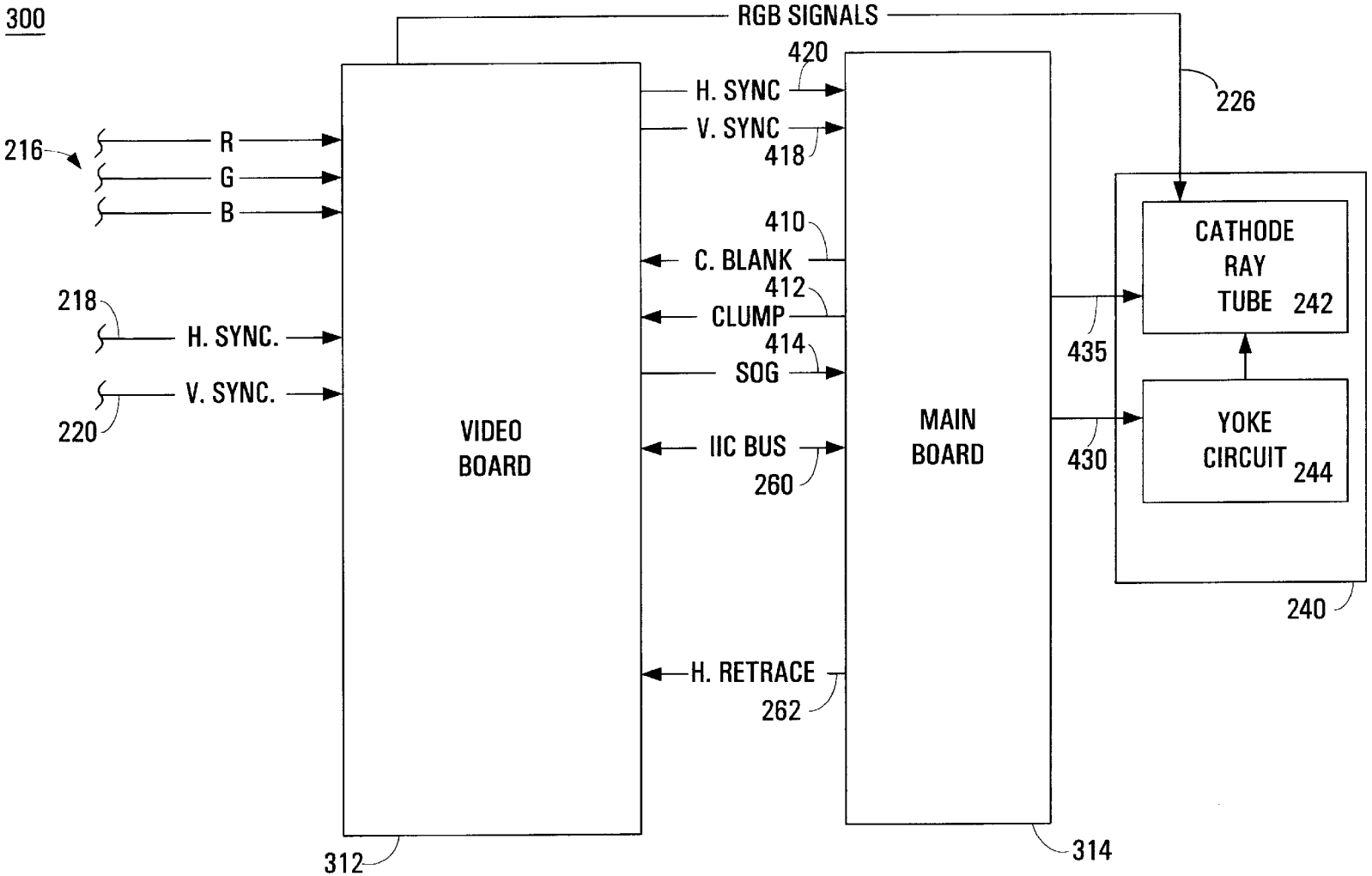
FIG. 3A is a high level block diagram of a monitor device in accordance with an embodiment of the present invention including a video signal counter circuit located on a video board and microprocessor located on a main board.
Figure 3B:
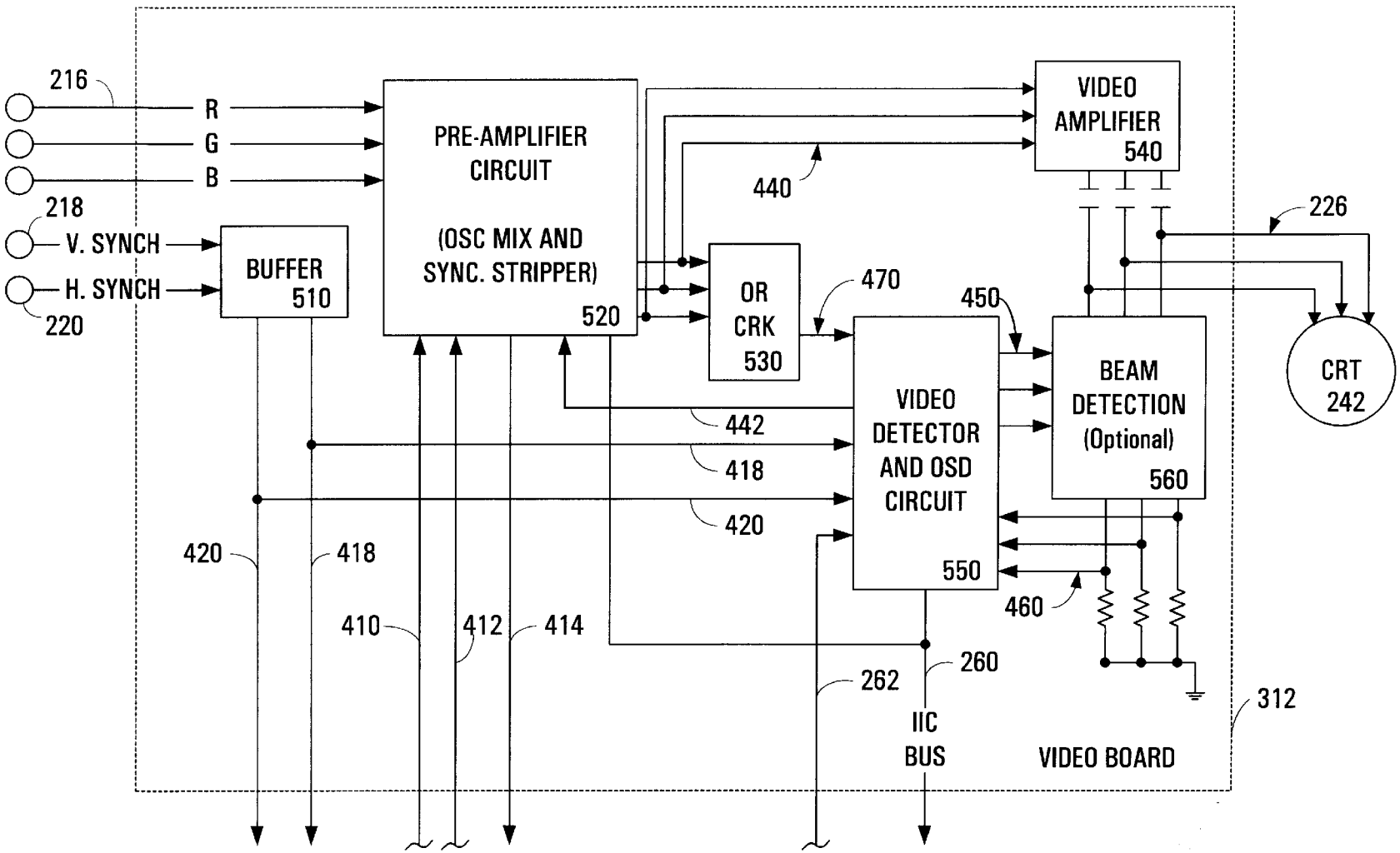
FIG. 3B illustrates a schematic diagram of the video board components of the monitor device of one embodiment of the present invention including the video signal counter circuit.
Figure 3C:
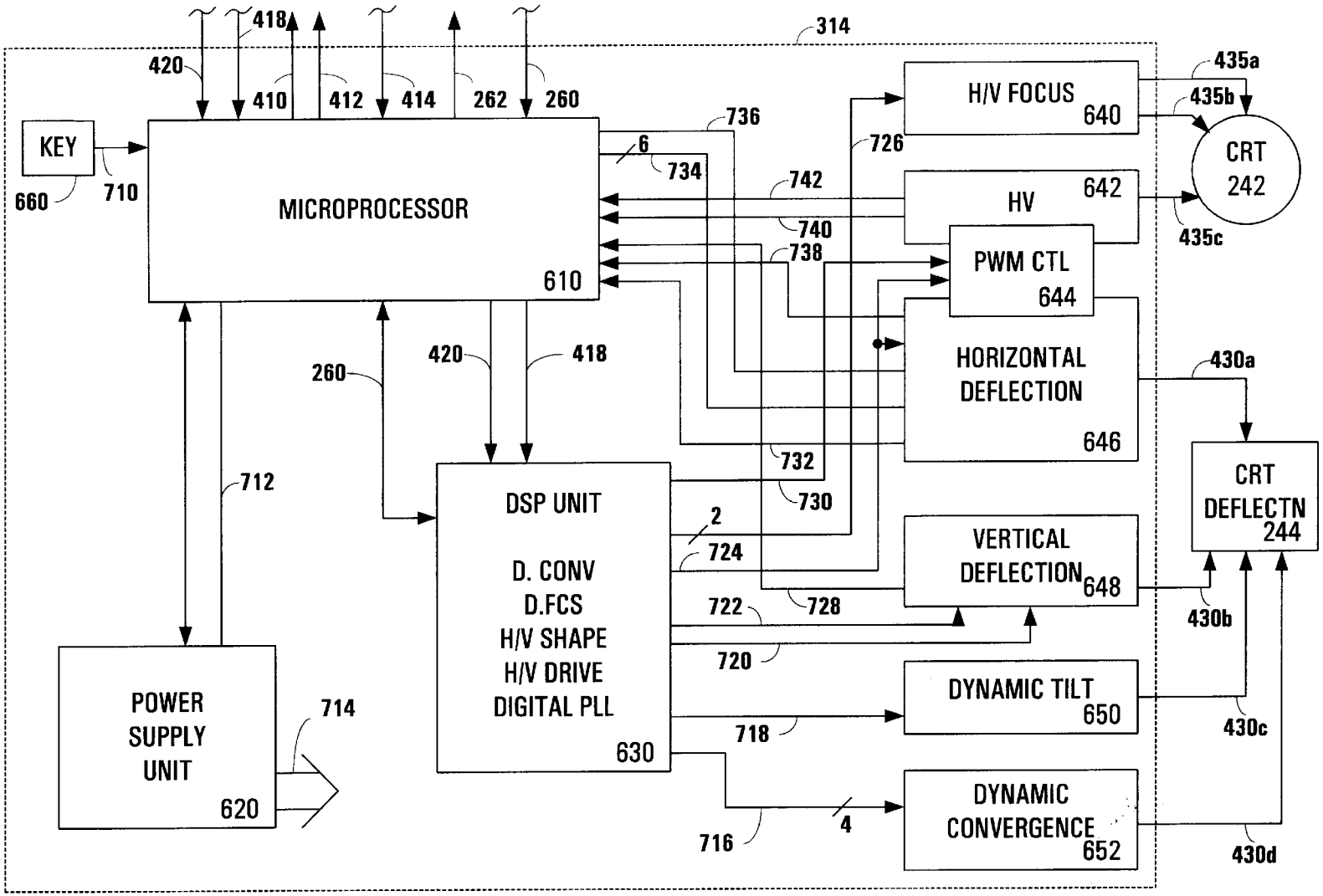
FIG. 3C illustrates a schematic diagram of the main board components of the monitor device of one embodiment of the present invention including the processor for performing automatic sizing and centering computations.

FIG. 3A, FIG. 3B, FIG. 3C illustrate a second embodiment 300 of the present invention. As shown in FIG. 3A, circuit embodiment 300 includes a video board 312 and a main board 314. The video board 312 receives the input video signal including the video color signals (red/green/blue) over bus 216 and the vertical and horizontal synchronization signals over lines 218 and 220, respectively. The vertical and horizontal synchronization signals are supplied to the main board 314 via lines 420 and 418. An SOG signal is supplied to the main board from the video board 312 via line 414. A count value from a video counter circuit of the video board 312 is supplied to the main board via a serial IIC transmission bus 260. The RGB color video signals are sent to the cathode ray tube unit 240 from the video board 312 via bus 226.

The main board 314 generates the following signals that are coupled to the video board 312. A blanking signal is supplied over line 410. A CLUMP signal is supplied over line 412. A horizontal retrace ("flyback") signal is forwarded over line 262. It is appreciated that the main board 312 controls the horizontal and vertical yoke deflection circuits 244 of the CRT display unit 240 via signals over bus 430 and also controls the cathode ray tube 242 via horizontal and vertical focusing signals over bus 435.

FIG. 3B illustrates the components of the video board 312 of circuit embodiment 300 of the present invention. A buffer circuit 510 receives the vertical and horizontal synchronization signals over lines 218 and 220 and supplies buffered forms of these signals over lines 418 and 420, respectively. Lines 418 and 420 are also supplied to a video counter and On-Screen Display (OSD) circuit 550. A preamplifier/receiver circuit 520 (coupled to the serial transmission line 260) receives and amplifies the video color signals from bus 216 and supplies the video color signals to an OR circuit 530 which generates the OR signal 470. The video color signals are also supplied to a video amplifier circuit 540 which supplies the amplified video color signals to the electron beam electronics of the cathode ray tube 424 of a display unit and also supplies the color signals (through diodes not shown) to an optional beam detection circuit 560. The preamplifier/receiver circuit 520 also receives the blanking signal over line 410 and the CLUMP signal over line 412. The preamplifier/receiver circuit 520 generates the SOG signal over line 414. The cut-off controller and beam detection circuit 560 receives red/green/blue cut-off signals over bus 450 from the video detector circuit 550 and also supplies red/green/blue beam signals to the video detector circuit 550 via bus 460.

In accordance with embodiment 300, the video counter circuit is integrated within the OSD circuitry within device 550 and located proximate to the input video signal. The OSD circuitry allows on-screen display of certain display attribute adjustments that can be made by the user following and interacting with on-screen icons and tools. For instance, using on-screen display images, a user can adjust the vertical size and the horizontal size of the display picture, also the vertical center and the horizontal center of the picture can be adjusted. On-screen tools can also be used to adjust the contrast and brightness of the picture as well as pin cushioning adjustments. Therefore, within circuit embodiment 300, the video counter circuit is integrated with the OSD circuitry into a single device 550. For this reason, the OR signal 470 is coupled to device 550 as well as the vertical and horizontal synchronization signals of lines 418 and 420. Also coupled to device 550 is the horizontal flyback signal over line 262. The OSD circuit components of device 550 generate red, green and blue OSD signals over bus 442 to the pre-amplifier circuit 520.

As described with respect to circuit embodiment 200 FIG. 2, the video counter circuit within device 550 of FIG. 3B is clocked by a high speed internal clock signal (e.g., 100 MHz or higher) and functions to compare the OR signal 470 with the synchronization signals discussed above. The results are digital count values presented on serial IIC bus 260 which represent the separation from the screen edge (e.g., the synchronization pulses) to the picture edge for the input video signal format. These digital count values are downloaded by a microprocessor (on main board 314) that performs automatic sizing and centering functions. It is appreciated that in alternative embodiments of the present invention, the OR circuit 530 can also be integrated together with the preamplifier circuit 520 into a single integrated circuit device to reduce layout size and pin count.

FIG. 3C illustrates the components of the main board 314 of circuit embodiment 300 of the present invention. The microprocessor unit 610, in combination with a DSP (digital signal processor) unit 630, perform automatic sizing and centering functions. Microprocessor unit 610 receives the horizontal and vertical synchronization signals over line 420 and line 418, respectively. Microprocessor unit 610 also receives the SOG signal over line 414. The serial transmission line 260 is coupled to microprocessor unit 610. A power supply unit 620 is also included on main board 314 which generates various DC voltage levels (e.g., +5 v, +8 v, +12 v, +16 v, +80 v and −12 v), including a heater supply, for the display unit. Bus 712 carries heater on/off, remote on/off, degauss, low beam detect and safety shutdown signals to and from the microprocessor unit 610. Microprocessor unit 610 transmits the vertical and horizontal signals over lines 418 and 420, respectively, to the DSP unit 630.

The DSP unit 630 is also coupled to the serial transmission line 260. Key unit 660 provides buttons on the face of the CRT display unit that when pushed generate signals over line 710 that active the on-screen display features discussed above. The DSP unit 630 also performs dynamic convergence and dynamic focus operations. These are well known in the art. Also, the DSP unit 630 performs horizontal and vertical shape and drive computations. The DSP unit 630 contains one or more digital phase lock loop circuits.

Control signals from the microprocessor unit 610 and the DSP unit 630 of FIG. 3C control the following cathode ray tube units. A horizontal and vertical (H/V) focus unit 640 is controlled as well as an HV circuit 642 and a pulse width modulator (PWM) circuit 644. Main board 314 also includes a horizontal deflection unit 646 and a vertical deflection unit 648. Also controlled are a dynamic tilt circuit 650 and a dynamic convergence circuit 652.

Specifically, the microprocessor unit 610 of FIG. 3C and the DSP unit 630 perform automatic picture sizing and centering functions and generate and respond to the following control signals. Microprocessor unit 610 generates the horizontal center signal and forwards this signal over line 736 to the horizontal deflection yoke 646. Horizontal sizing information is forwarded over multi-bus 734 from the microprocessor unit 610 to the horizontal deflection circuit 646. The vertical deflection circuit 648 is controlled by a vertical shape control signal of line 722 and a vertical pin signal over line 720; both signals are generated by the DSP unit 630. Separate horizontal and vertical focus signals are generated by the DSP unit 630 and coupled to the HN focus circuit 640 via bus 726. The HV circuit 642 generates an HV detect signal and an ABL signal which are coupled to the microprocessor via lines 742 and 740, respectively.

The vertical deflection circuit 648 generates the vertical flyback signal which is coupled to the microprocessor unit 610 via line 728. The horizontal deflection circuit 648 generates a horizontal flyback signal which is coupled to the microprocessor unit 610 via line 732. Also generated by the horizontal deflection unit is a thermal signal coupled to the microprocessor unit 610 via line 738. The DSP circuit 630 generates a horizontal shape signal which is coupled to the pulse width modulation circuit 644 via line 730. The DSP circuit630 also generates a horizontal drive signal that is coupled to both the horizontal deflection circuit 648 and the pulse width modulation circuit 644 via line 724. The DSP unit 630 generates dynamic tilt and horizontal trap signals over line 718 which is coupled to a dynamic tilt circuit 650. The DSP unit 630 also generates four dynamic convergence bits over multi-bit bus 716 which is coupled to a dynamic convergence unit 652.

The cathode ray tube 242 of FIG. 3C is coupled to the main board 314 in the following manner. The HV and horizontal and vertical pins of the cathode ray tube 242 are coupled to lines 435*a*, 435*b* and 435*c*, respectively. Also, the horizontal and vertical magnetic deflection units of the CRT magnetic deflection circuitry 244 are controlled by lines 430*a* and 430*b*, respectively. The dynamic tilt circuit controls the CRT magnetic deflection device 244 via line 430*c* and the CRT magnetic deflection device 244 is controlled by line 430*d*.

Automatic sizing and centering operations of the present invention are performed by the microprocessor unit 610 and the DSP unit 630 based on the count values received over transmission line 260 from the video counter circuit of unit 550 (in the video board 312). These operations control the generation of the horizontal centering signals, the horizontal shaping signals, the vertical shaping signals and the vertical pin signals.

It is appreciated that circuit embodiment 300 of the present invention, like circuit embodiment 200, offers increased protection against EMI radiation, noise and signal jitter and delay by locating the video counter circuitry (e.g., within OSD circuit 550) on the video board 312 and proximate to the input video signal. Also, the transmission line 260 is an IIC serial transmission line that, in one implementation, is shielded. Further, the microprocessor unit 610 and DSP unit 630 are located proximate to the deflection control circuits of the main board to further reduce signal noise problems. Accuracy of the automatic sizing and centering functions is increased due to noise reduction in the pertinent signal lines. The high speed internal clock of the video counter circuitry also increases accuracy of its output count signal thereby increasing accuracy of the automatic sizing and centering functions. The addition of the video counter circuit in unit 550 also provides increased flexibility in the positioning of the microprocessor and therefore increased flexibility in the layout of the overall circuit design.

Host Computer Architecture

FIG. 4 illustrates a computer system 112 that includes a display device 150*b* implemented with the automatic centering and sizing circuitry of the present invention having a video counter circuit implemented on the video board and in communication with a microprocessor unit. Although a variety of different computer systems can be used with the present invention, an exemplary general purpose computer system 112 is shown in FIG. 4.

In general, computer system 112 includes an address/data bus 100 for communicating information, a central or host processor 101 coupled with the bus for processing information and instructions, a volatile memory 102 (e.g., random access memory RAM) coupled with the bus 100 for storing information and instructions for the central processor 101 and a non-volatile memory 103 (e.g., read only memory ROM) coupled with the bus 100 for storing static information and instructions for the processor 101. Computer system 112 also includes a data storage device 104 ("disk subsystem") such as a magnetic or optical disk and disk drive coupled with the bus 100 for storing information and instructions and a display device 105 coupled to the bus 100 for displaying information to the computer user.

Also included in computer system 112 of FIG. 4 is an alphanumeric input device 106 including alphanumeric and function keys coupled to the bus 100 for communicating information and command selections to the central processor 101. System 112 also includes a cursor control or directing device 107 coupled to the bus for communicating user input information and command selections to the central processor 101. The cursor directing device 107 can be implemented using a number of well known devices such as a mouse, a track ball, a track pad, an electronic pad and stylus, an optical tracking device, a touch screen etc. Computer system 112 can also include an optional signal generating device 108 coupled to the bus 100 for interfacing with other networked computer systems.

As discussed above, the display device 105*b* utilized with the computer system 112 of the present invention is a CRT display device implemented with the circuitry 200 of FIG. 2 or the circuitry 300 of FIG. 3B and FIG. 3C, of the present invention, and is suitable for creating graphic images and alphanumeric characters recognizable to the user. The CRT device 105*b* is coupled to computer system 112 via a graphics (e.g., "video") card 105*a* that is typically located within the chassis of the host computer system. Video card 105*a* contains video memory and generates the video signal over line 205 that is received by circuit 200 and circuit 300.

The preferred embodiment of the present invention, an automatic sizing and centering circuit for a monitor device, is thus described. While the present invention has been described in particular embodiments, it should be appreciated that the present invention should not be construed as limited by such embodiments, but rather construed according to the below claims.

What is claimed is:

1. A control circuit for a display device, said control circuit comprising:

a) a first board comprising:

a video receiver circuit for receiving video color signals of an input video signal;

an OR circuit coupled to said video receiver circuit for generating an OR signal that is an OR function of said video color signals; and a video counter circuit coupled to said OR circuit and for comparing said OR signal with synchronization signals of said video input signal and for generating, over a transmission line, a digital count signal indicative thereof; and b) a second board coupled to said first board and comprising:

a microprocessor coupled to said transmission line for performing automatic sizing and centering computations to generate sizing signals and centering signals; and a yoke controller circuit coupled to receive said sizing signals and said centering signals and for controlling electronic beam deflection circuits within said display device.

2. A control circuit as described in claim 1 further comprising an On-Screen Display (OSD) circuit and wherein said video counter circuit is integrated within said OSD circuit of said first board.

3. A control circuit as described in claim 1 further comprising an oscillator circuit for generating a high speed clock signal coupled to said video counter circuit.

4. A control circuit as described in claim 3 wherein said high speed clock signal is at least 100 MHz.

5. A control circuit as described in claim 1 wherein said video color signals include a red color signal, a green color signal and a blue color signal and wherein said video synchronization signals include a horizontal synchronization signal and a vertical synchronization signal.

6. A control circuit as described in claim 1 wherein said sizing signals include a horizontal sizing signal and a vertical sizing signal and wherein said centering signals include a horizontal centering signal and a vertical centering signal.

7. A control circuit as described in claim 1 wherein said video receiver circuit and said OR circuit are integrated together within an integrated circuit device.

8. A control circuit as described in claim 1 wherein said transmission line is a serial transmission line.

9. A control circuit for a display device, said control circuit comprising:

a) a first board comprising:
- a video receiver circuit for receiving video color signals of an input video signal;
- an OR circuit coupled to said video receiver circuit for generating an OR signal that is an OR function of said video color signals; and
- a video counter circuit coupled to said OR circuit and for comparing said OR signal with synchronization signals of said video input signal and for generating, over a serial transmission line, a digital count signal indicative thereof; and b) a second board coupled to said first board and comprising:
- a microprocessor coupled to said serial transmission line for performing automatic sizing and centering computations to generate horizontal and vertical sizing signals and for generating horizontal and vertical centering signals; and
- a yoke controller circuit coupled to receive said horizontal and vertical sizing signals and said horizontal and vertical centering signals and for controlling electronic beam deflection circuits within said display device.

10. A control circuit as described in claim 9 further comprising an On-Screen Display (OSD) circuit and wherein said video counter circuit is integrated within said OSD circuit of said first board.

11. A control circuit as described in claim 9 further comprising an oscillator circuit for generating a high speed clock signal coupled to said video counter circuit.

12. A control circuit as described in claim 9 wherein said video color signals include a red color signal, a green color signal and a blue color signal and wherein said video synchronization signals include a horizontal synchronization signal and a vertical synchronization signal.

13. A control circuit as described in claim 9 wherein said video receiver circuit and said OR circuit are integrated together within an integrated circuit device.

14. A display device comprising:

a) a cathode ray tube comprising electronic beam deflection circuits for controlling an electron beam;

b) a first board comprising:
- a video receiver circuit for receiving video color signals of an input video signal;
- an OR circuit coupled to said video receiver circuit for generating an OR signal that is an OR function of said video color signals; and
- a video counter circuit coupled to said OR circuit and for comparing said OR signal with synchronization signals of said video input signal and for generating, over a transmission line, a digital count signal indicative thereof; and c) a second board coupled to said first board and comprising:
- a microprocessor coupled to said transmission line for performing automatic sizing and centering computations to generate sizing signals and centering signals; and
- a yoke controller circuit coupled to receive said sizing signals and said centering signals and for controlling said electronic beam deflection circuits.

15. A display device as described in claim 14 further comprising an On-Screen Display (OSD) circuit and wherein said video counter circuit is integrated within said OSD circuit of said first board.

16. A display device as described in claim 14 further comprising an oscillator circuit for generating a high speed clock signal coupled to said video counter circuit.

17. A display device as described in claim 14 wherein said video color signals include a red color signal, a green color signal and a blue color signal and wherein said video synchronization signals include a horizontal synchronization signal and a vertical synchronization signal.

18. A display device as described in claim 14 wherein said sizing signals include a horizontal sizing signal and a vertical sizing signal and wherein said centering signals include a horizontal centering signal and a vertical centering signal.

19. A display device as described in claim 14 wherein said video receiver circuit and said OR circuit are integrated together within an integrated circuit device.

20. A display device as described in claim 14 wherein said transmission line is a serial transmission line.

* * * * *